US007175687B2

(12) United States Patent
Bangaru et al.

(10) Patent No.: US 7,175,687 B2
(45) **Date of Patent: *Feb. 13, 2007**

(54) ADVANCED EROSION-CORROSION RESISTANT BORIDE CERMETS

(75) Inventors: Narasimha-Rao Venkata Bangaru, Annandale, NJ (US); ChangMin Chun, Belle Mead, NJ (US); Neeraj Srinivas Thirumalai, Phillipsburg, NJ (US); Hyun-Woo Jin, Phillipsburg, NJ (US); Jayoung Koo, Bridgewater, NJ (US); John Roger Peterson, Ashburn, VA (US); Robert Lee Antram, Warrenton, VA (US); Christopher John Fowler, Springfield, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/829,816

(22) Filed: Apr. 22, 2004

(65) Prior Publication Data

US 2007/0006679 A1 Jan. 11, 2007

Related U.S. Application Data

(60) Provisional application No. 60/471,993, filed on May 20, 2003.

(51) Int. Cl.
*C22C 29/14* (2006.01)

(52) U.S. Cl. ..... 75/244

(58) Field of Classification Search ..... 75/252, 75/244

See application file for complete search history.

(56) References Cited

U.S. PATENT DOCUMENTS

| | | | | |
|---|---|---|---|---|
| 1,968,067 | A | 7/1934 | Balke | 75/1 |
| 3,194,656 | A | 7/1965 | Vordahl | 75/135 |
| 3,705,791 | A * | 12/1972 | Bredzs | 428/565 |
| 3,752,655 | A | 8/1973 | Ramqvist | 29/182.5 |
| 3,941,903 | A | 3/1976 | Tucker, Jr. | 427/190 |
| 3,999,952 | A | 12/1976 | Kondo et al. | 29/182.5 |
| 4,145,213 | A | 3/1979 | Oskarsson et al. | 75/238 |
| 4,194,900 | A | 3/1980 | Ide et al. | 75/0.5 C |
| 4,365,994 | A | 12/1982 | Ray | 75/123 B |
| 4,379,852 | A | 4/1983 | Watanabe et al. | 501/87 |
| 4,397,800 | A | 8/1983 | Suzuki et al. | 264/61 |
| 4,401,724 | A | 8/1983 | Moskowitz et al. | 428/564 |
| 4,403,014 | A | 9/1983 | Bergmann | 428/546 |
| 4,419,130 | A | 12/1983 | Slaughter | 75/244 |
| 4,420,110 | A | 12/1983 | McCullough et al. | 228/54 |
| 4,426,423 | A | 1/1984 | Intrater et al. | 428/408 |
| 4,436,560 | A | 3/1984 | Fujita et al. | 148/6 |
| 4,439,236 | A | 3/1984 | Ray | 75/123 B |
| 4,456,518 | A | 6/1984 | Bommaraju | 204/190 F |
| 4,467,240 | A | 8/1984 | Futamoto et al. | 313/336 |
| 4,470,053 | A | 9/1984 | Maffitt et al. | 346/135.1 |
| 4,475,983 | A | 10/1984 | Bader et al. | 156/656 |
| 4,501,799 | A | 2/1985 | Driessen et al. | 428/446 |
| 4,505,746 | A | 3/1985 | Nakai et al. | 75/243 |
| 4,515,866 | A | 5/1985 | Okamoto et al. | 428/614 |
| 4,529,494 | A | 7/1985 | Joo et al. | 204/290 R |
| 4,533,004 | A | 8/1985 | Ecer | 175/329 |
| 4,535,029 | A | 8/1985 | Intrater et al. | 428/408 |
| 4,545,968 | A | 10/1985 | Hirano et al. | 423/290 |
| 4,552,637 | A | 11/1985 | Vire et al. | 204/243 R |
| 4,564,401 | A | 1/1986 | Strichman et al. | 148/104 |
| 4,564,555 | A | 1/1986 | Hornberger | 428/312.8 |
| 4,576,653 | A | 3/1986 | Ray | 148/3 |
| 4,596,994 | A | 6/1986 | Matsuda et al. | 346/140 R |
| 4,610,550 | A | 9/1986 | Thomke et al. | 368/281 |
| 4,610,810 | A | 9/1986 | Hasegawa et al. | 252/511 |
| 4,615,913 | A | 10/1986 | Jones et al. | 427/226 |
| 4,626,464 | A | 12/1986 | Jachowski et al. | 428/212 |
| 4,643,951 | A | 2/1987 | Keem et al. | 428/469 |
| 4,652,710 | A | 3/1987 | Karnowsky et al. | 200/235 |
| 4,670,408 | A | 6/1987 | Petzow et al. | 501/87 |
| 4,671,822 | A | 6/1987 | Hamashima et al. | 75/244 |
| 4,673,550 | A | 6/1987 | Dallaire et al. | 419/12 |
| 4,681,671 | A | 7/1987 | Duruz | 204/67 |
| 4,690,796 | A | 9/1987 | Paliwal | 419/12 |
| 4,696,764 | A | 9/1987 | Yamazaki | 252/503 |
| 4,707,384 | A | 11/1987 | Schachner et al. | 427/249 |

(Continued)

FOREIGN PATENT DOCUMENTS

EP 0115688 A2 8/1984

(Continued)

OTHER PUBLICATIONS

Ralf Riedel (EditorO: "Handbook of Ceramic Hard Materials," 2000, Wiley-VCH, Germany, XP002303272, pp. 897-945.

(Continued)

*Primary Examiner*—Ngoclan T. Mai
(74) *Attorney, Agent, or Firm*—Ramesh Varadaraj; Robert A. Migliorini

(57) ABSTRACT

A cermet composition represented by the formula (PQ)(RS) comprising: a ceramic phase (PQ) and binder phase (RS) wherein, P is at least one metal selected from the group consisting of Group IV, Group V, Group VI elements, Q is boride, R is selected from the group consisting of Fe, Ni, Co, Mn and mixtures thereof, S comprises at least one element selected from Cr, Al, Si and Y.

34 Claims, 7 Drawing Sheets

U.S. PATENT DOCUMENTS

| | | | | |
|---|---|---|---|---|
| 4,710,348 | A | 12/1987 | Brupbacher et al. | 420/129 |
| 4,711,660 | A | 12/1987 | Kemp, Jr. et al. | 75/0.5 B |
| 4,717,534 | A | 1/1988 | Morita | 376/419 |
| 4,718,941 | A | 1/1988 | Halverson et al. | 75/236 |
| 4,721,878 | A | 1/1988 | Hagiwara et al. | 313/362.1 |
| 4,725,508 | A | 2/1988 | Rangaswamy et al. | 428/570 |
| 4,729,504 | A | 3/1988 | Edamura | 228/122 |
| 4,734,339 | A | 3/1988 | Schachner et al. | 428/701 |
| 4,744,947 | A | 5/1988 | Nilmen et al. | 420/590 |
| 4,751,048 | A | 6/1988 | Christodoulou et al. | 420/129 |
| 4,755,221 | A | 7/1988 | Paliwal et al. | 75/244 |
| 4,761,344 | A | 8/1988 | Maki et al. | 428/552 |
| 4,790,873 | A | 12/1988 | Gesing et al. | 75/68 R |
| 4,806,161 | A | 2/1989 | Fabiny et al. | 106/14.12 |
| 4,808,055 | A | 2/1989 | Wertz et al. | 416/224 |
| 4,833,041 | A | 5/1989 | McComas | 428/610 |
| 4,836,982 | A | 6/1989 | Brupbacher et al. | 420/129 |
| 4,838,936 | A | 6/1989 | Akechi | 75/249 |
| 4,843,206 | A | 6/1989 | Azuma et al. | 219/119 |
| 4,847,025 | A | 7/1989 | White et al. | 501/87 |
| 4,851,375 | A | 7/1989 | Newkirk et al. | 501/88 |
| 4,859,124 | A | 8/1989 | Moskowitz et al. | 409/64 |
| 4,873,038 | A | 10/1989 | Rapp et al. | 264/60 |
| 4,880,600 | A | 11/1989 | Moskowitz et al. | 419/12 |
| 4,885,030 | A | 12/1989 | Moskowitz et al. | 75/238 |
| 4,889,745 | A | 12/1989 | Sata | 427/12 |
| 4,915,902 | A | 4/1990 | Brupbacher et al. | 420/129 |
| 4,915,908 | A | 4/1990 | Nagle et al. | 420/590 |
| 4,916,030 | A | 4/1990 | Christodoulou et al. | 428/614 |
| 4,929,513 | A | 5/1990 | Kyono et al. | 428/611 |
| 4,935,055 | A | 6/1990 | Aghajanian et al. | 164/66.1 |
| 4,948,676 | A | 8/1990 | Darracq et al. | 428/539.5 |
| 4,950,327 | A | 8/1990 | Eck et al. | 75/232 |
| 4,966,626 | A | 10/1990 | Fujiki et al. | 75/238 |
| 4,970,092 | A | 11/1990 | Gavrilov et al. | 427/37 |
| 4,995,444 | A | 2/1991 | Jolly et al. | 164/97 |
| 4,999,050 | A | 3/1991 | Sanchez-Caldera et al. | 75/244 |
| 5,004,036 | A | 4/1991 | Becker | 164/97 |
| 5,010,945 | A | 4/1991 | Burke | 164/97 |
| 5,020,584 | A | 6/1991 | Aghajanian et al. | 164/97 |
| 5,045,512 | A * | 9/1991 | Lange et al. | 501/96.1 |
| 5,051,382 | A | 9/1991 | Newkirk et al. | 501/87 |
| 5,053,074 | A * | 10/1991 | Buljan et al. | 75/236 |
| 5,059,490 | A | 10/1991 | Brupbacher et al. | 428/614 |
| 5,089,047 | A * | 2/1992 | Buljan et al. | 75/236 |
| 5,217,816 | A | 6/1993 | Brupbacher et al. | 428/614 |
| 5,336,527 | A | 8/1994 | Takahashi et al. | 427/357 |
| 5,409,518 | A | 4/1995 | Saito et al. | 75/44 |
| 5,520,879 | A | 5/1996 | Saito et al. | 419/38 |
| 5,744,254 | A | 4/1998 | Kampe et al. | 428/614 |
| 5,837,327 | A | 11/1998 | Sue et al. | 427/456 |
| 5,854,434 | A | 12/1998 | Saito et al. | 75/244 |
| 5,854,966 | A | 12/1998 | Kampe et al. | 419/67 |
| 5,981,081 | A | 11/1999 | Sue | 428/564 |
| 6,007,922 | A | 12/1999 | Sue et al. | 428/561 |
| 6,022,508 | A | 2/2000 | Berns | 419/6 |
| 6,193,928 | B1 | 2/2001 | Rauscher et al. | 419/45 |
| 6,228,185 | B1 | 5/2001 | Davies et al. | 148/437 |
| 6,290,748 | B1 | 9/2001 | Jha et al. | 75/684 |
| 6,293,986 | B1 * | 9/2001 | Rodiger et al. | 75/236 |
| 6,372,013 | B1 | 4/2002 | Trout et al. | 75/309 |
| 6,544,636 | B1 | 4/2003 | Fukunaga et al. | 428/293.1 |
| 6,615,935 | B2 | 9/2003 | Fang et al. | 175/374 |
| 2002/0162691 | A1 | 11/2002 | Fang et al. | 175/374 |

FOREIGN PATENT DOCUMENTS

| | | |
|---|---|---|
| EP | 0426608 | 5/1991 |
| EP | 0659894 | 6/1995 |
| EP | 1077270 A1 | 2/2001 |
| GB | 1404734 | 9/1975 |
| GB | 1486964 | 9/1977 |
| GB | 2109409 | 6/1983 |
| JP | 11209841 | 8/1999 |

OTHER PUBLICATIONS

S. S. Ordan'yan et al, Temperature Dependence of the Strength of Sintered TiB2-Fe Composites, Leningrad Technological Institute, UDC 621,762, No. 7 (235), pp. 94-97, Jul. 1982. Original article submitted Jan. 12, 1981 [595-597].

* cited by examiner

ADVANCED EROSION-CORROSION RESISTANT BORIDE CERMETS

This application claims the benefit of U.S. Provisional application 60/471,993 filed May 20, 2003.

FIELD OF INVENTION

The present invention is broadly concerned with cermets, particularly cermet compositions comprising a metal boride. These cermets are suitable for high temperature applications wherein materials with superior erosion and corrosion resistance are required.

BACKGROUND OF INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are used currently for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials is chemically bonded castable alumina refractories. These castable alumina refractories are applied to the surfaces in need of protection and upon heat curing hardens and adheres to the surface via metal-anchors or metal-reinforcements. It also readily bonds to other refractory surfaces. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation. Therefore there is a need for materials with superior erosion and corrosion resistance properties for high temperature applications. The cermet compositions of the instant invention satisfy this need.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

The present invention includes new and improved cermet compositions.

The present invention also includes cermet compositions suitable for use at high temperatures.

Furthermore, the present invention includes an improved method for protecting metal surfaces against erosion and corrosion under high temperature conditions.

These and other objects will become apparent from the detailed description which follows.

SUMMARY OF INVENTION

The invention includes a cermet composition represented by the formula (PQ)(RS) comprising: a ceramic phase (PQ) and binder phase (RS) wherein, P is at least one metal selected from the group consisting of Group IV, Group V, Group VI elements, Q is boride, R is selected from the group consisting of Fe, Ni, Co, Mn and mixtures thereof, S comprises at least one element selected from Cr, Al, Si and Y.

DETAILED DESCRIPTION OF THE INVENTION

Figure 1:
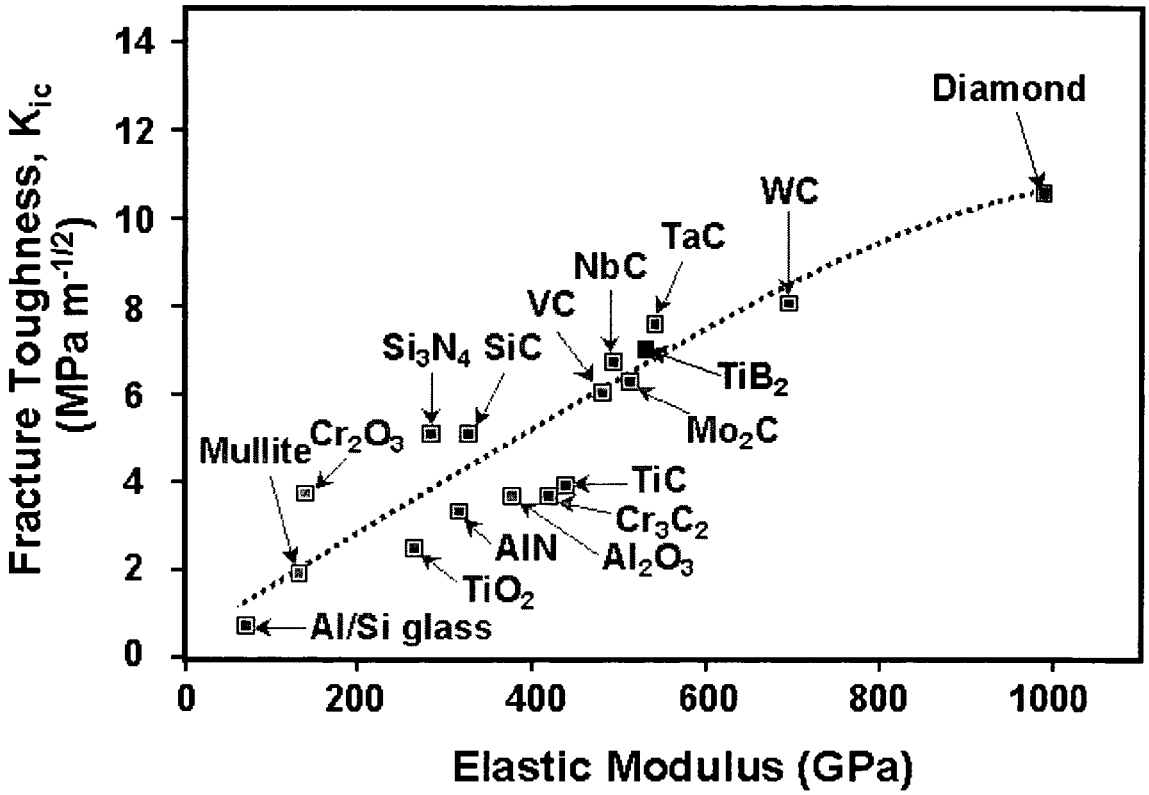
FIG. 1 shows that of all the ceramics, titanium diboride ($TiB_2$) has exceptional fracture toughness rivaling that of diamond but with greater chemical stability.

Materials such as ceramics are primarily elastic solids and cannot deform plastically. They undergo cracking and fracture when subjected to large tensile stress such as induced by solid particle impact of erosion process when these stresses exceed the cohesive strength (fracture toughness) of the ceramic. Increased fracture toughness is indicative of higher cohesive strength. During solid particle erosion, the impact force of the solid particles cause localized cracking, known as Hertzian cracks, at the surface along planes subject to maximum tensile stress. With continuing impacts, these cracks propagate, eventually link together, and detach as small fragments from the surface. This Hertzian cracking and subsequent lateral crack growth under particle impact has been observed to be the primary erosion mechanism in ceramic materials. FIG. 1 shows that of all the ceramics, titanium diboride ($TiB_2$) has exceptional fracture toughness rivaling that of diamond but with greater chemical stability. The fracture toughness vs. elastic modulus plot is referred to the paper presented in the Gareth Thomas Symposium on Microstructure Design of Advanced Materials, 2002 TMS Fall Meeting, Columbus Ohio, entitled "Microstructure Design of Composite Materials: WC—Co Cermets and their Novel Architectures" by K. S. Ravichandran and Z. Fang, Dept of Metallurgical Eng, Univ. of Utah.

In cermets, cracking of the ceramic phase initiates the erosion damage process. For a given erodant and erosion conditions, key factors governing the material erosion rate (E) are hardness and toughness of the material as shown in the following equation $$E \propto (K_{IC})^{-4/3} \cdot H^{q}$$

where $K_{IC}$ and H are fracture toughness and hardness of target material and q is experimentally determined number.

One component of the cermet composition represented by the formula (PQ)(RS) is the ceramic phase denoted as (PQ). In the ceramic phase (PQ), P is a metal selected from the group consisting of Group IV, Group V, Group VI elements of the Long Form of The Periodic Table of Elements and mixtures thereof. Q is boride. Thus the ceramic phase (PQ) in the boride cermet composition is a metal boride. Titanium diboride, $TiB_2$ is a preferred ceramic phase. The molar ratio of P to Q in (PQ) can vary in the range of 3:1 to 1:6. As non-limiting illustrative examples, when P=Ti, (PQ) can be $TiB_2$ wherein P:Q is about 1:2. When P=Cr, then (PQ) can be $Cr_2B$ wherein P:Q is 2:1. The ceramic phase imparts hardness to the boride cermet and erosion resistance at temperatures up to about 850° C. It is preferred that the particle size of the ceramic phase is in the range 0.1 to 3000 microns in diameter. More preferably the ceramic particle size is in the range 0.1 to 1000 microns in diameter. The dispersed ceramic particles can be any shape. Some non-limiting examples include spherical, ellipsoidal, polyhedral, distorted spherical, distorted ellipsoidal and distorted polyhedral shaped. By particle size diameter is meant the measure of longest axis of the 3-D shaped particle. Microscopy methods such as optical microscopy (OM), scanning electron microscopy (SEM) and transmission electron microscopy (TEM) can be used to determine the particle sizes. In another embodiment of this invention, the ceramic phase (PQ) is in the form of platelets with a given aspect ratio, i.e., the ratio of length to thickness of the platelet. The ratio of length:thickness can vary in the range of 5:1 to 20:1. Platelet microstructure imparts superior mechanical properties through efficient transfer of load from the binder phase (RS) to the ceramic phase (PQ) during erosion processes.

Another component of the boride cermet composition represented by the formula (PQ)(RS) is the binder phase denoted as (RS). In the binder phase (RS), R is the base metal selected from the group consisting of Fe, Ni, Co, Mn, and mixtures thereof. In the binder phase the alloying element S consists essentially of at least one element selected from Cr, Al, Si and Y. The binder phase alloying element S may further comprise at least one element selected from the group consisting of Ti, Zr, Hf, V, Nb, Ta, Mo and W. The Cr and Al metals provide for enhanced corrosion and erosion resistance in the temperature range of 25° C. to 850° C. The elements selected from the group consisting of Y, Si, Ti, Zr, Hf, V, Nb, Ta, Mo, W provide for enhanced corrosion resistance in combination with the Cr and/or Al. Strong oxide forming elements such as Y, Al, Si and Cr tend to pick up residual oxygen from powder metallurgy processing and to form oxide particles within the cermet. In the boride cermet composition, (RS) is in the range of 5 to 70 vol % based on the volume of the cermet. Preferably, (RS) is in the range of 5 to 45 vol %. More preferably, (RS) is in the range of 10 to 30 vol %. The mass ratio of R to S can vary in the range from 50/50 to 90/10. In one preferred embodiment the combined chromium and aluminum content in the binder phase (RS) is at least 12 wt % based on the total weight of the binder phase (RS). In another preferred embodiment chromium is at least 12 wt % and aluminum is at least 0.01 wt % based on the total weight of the binder phase (RS). It is preferred to use a binder that provides enhanced long-term microstructural stability for the cermet. One example of such a binder is a stainless steel composition comprising of 0.1 to 3.0 wt % Ti especially suited for cermets wherein (PQ) is a boride of Ti such as $TiB_2$.

The cermet composition can further comprise secondary borides (P'Q) wherein P' is selected from the group consisting of Group IV, Group V, Group VI elements of the Long Form of The Periodic Table of Elements, Fe, Ni, Co, Mn, Cr, Al, Y, Si, Ti, Zr, Hf, V, Nb, Ta, Mo and W. Stated differently, the secondary borides are derived from the metal elements from P, R, S and combinations thereof of the cermet composition (PQ)(RS). The molar ratio of P' to Q in (P'Q) can vary in the range of 3:1 to 1:6. For example, the cermet composition can comprise a secondary boride (P'Q), wherein P' is Fe and Cr and Q is boride. The total ceramic phase volume in the cermet of the instant invention includes both (PQ) and the secondary borides (P'Q). In the boride cermet composition (PQ)+(P'Q) ranges from of about 30 to 95 vol % based on the volume of the cermet. Preferably from about 55 to 95 vol % based on the volume of the cermet. More preferably from about 70 to 90 vol % based on the volume of the cermet.

The cermet composition can further comprise oxides of metal selected from the group consisting of Fe, Ni, Co, Mn, Al, Cr, Y, Si, Ti, Zr, Hf, V, Nb, Ta, Mo and W and mixtures thereof. Stated differently, the oxides are derived from the metal elements from R, S and combinations thereof of the cermet composition (PQ)(RS).

The volume percent of cermet phase (and cermet components) excludes pore volume due to porosity. The cermet can be characterized by a porosity in the range of 0.1 to 15 vol %. Preferably, the volume of porosity is 0.1 to less than 10% of the volume of the cermet. The pores comprising the porosity is preferably not connected but distributed in the cermet body as discrete pores. The mean pore size is preferably the same or less than the mean particle size of the ceramic phase (PQ).

One aspect of the invention is the micro-morphology of the cermet. The ceramic phase can be dispersed as spherical, ellipsoidal, polyhedral, distorted spherical, distorted ellipsoidal and distorted polyhedral shaped particles or platelets. Preferably, at least 50% of the dispersed particles is such that the particle—particle spacing between the individual boride ceramic particles is at least about 1 nm. The particle—particle spacing may be determined for example by microscopy methods such as SEM and TEM.

The cermet compositions of the instant invention possess enhanced erosion and corrosion properties. The erosion rates were determined by the Hot Erosion and Attrition Test (HEAT) as described in the examples section of the disclosure. The erosion rate of the boride cermets of the instant invention is less than $0.5\times10^{-6}$ cc/gram of SiC erodant. The corrosion rates were determined by thermogravimetric (TGA) analyses as described in the examples section of the disclosure. The corrosion rate of the boride cermets of the instant invention is less than $1\times10^{-10}$ $g^2/cm^4 \cdot s$.

The cermet compositions possess fracture toughness of greater than about 3 $MPa \cdot m^{1/2}$, preferably greater than about 5 $MPa \cdot m^{1/2}$, and more preferably greater than about 10 $MPa \cdot m^{1/2}$. Fracture toughness is the ability to resist crack propagation in a material under monotonic loading conditions. Fracture toughness is defined as the critical stress intensity factor at which a crack propagates in an unstable manner in the material. Loading in three-point bend geometry with the pre-crack in the tension side of the bend sample is preferably used to measure the fracture toughness with fracture mechanics theory. (RS) phase of the cermet of the instant invention as described in the earlier paragraphs is primarily responsible for imparting this attribute.

Another aspect of the invention is the avoidance of embrittling intermetallic precipitates such as sigma phase known to one of ordinary skill in the art of metallurgy. The boride cermet of the instant invention has preferably less than about 5 vol % of such embrittling phases. The cermet of the instant invention with (PQ) and (RS) phases as described in the earlier paragraphs is responsible for imparting this attribute of avoidance of embrittling phases.

The cermet compositions are made by general powder metallurgical technique such as mixing, milling, pressing, sintering and cooling, employing as starting materials a suitable ceramic powder and a binder powder in the required volume ratio. These powders are milled in a ball mill in the presence of an organic liquid such as ethanol for a time sufficient to substantially disperse the powders in each other. The liquid is removed and the milled powder is dried, placed in a die and pressed into a green body. The resulting green body is then sintered at temperatures above about 1200° C. up to about 1750° C. for times ranging from about 10 minutes to about 4 hours. The sintering operation is preferably performed in an inert atmosphere or a reducing atmosphere or under vacuum. For example, the inert atmosphere can be argon and the reducing atmosphere can be hydrogen. Thereafter the sintered body is allowed to cool, typically to ambient conditions. The cermet prepared according to the process of the invention allows fabrication of bulk cermet materials exceeding 5 mm in thickness.

One feature of the cermets of the invention is their long term micro-structural stability, even at elevated temperatures, making them particularly suitable for use in protecting metal surfaces against erosion at temperatures in the range of about 300° C. to about 850° C. This stability permits their use for time periods greater than 2 years, for example for about 2 years to about 20 years. In contrast many known cermets undergo transformations at elevated temperatures which results in the formation of phases which have a deleterious effect on the properties of the cermet.

The long term microstructural stability of the cermet composition of the instant invention can be determined by computational thermodynamics using calculation of phase diagram (CALPHAD) methods known to one of ordinary skill in the art of computational thermodynamic calculation methods. These calculations can confirm that the various ceramic phases, their amounts, the binder amount and the chemistries lead to cermet compositions with long term microstructural stability. For example in the cermet composition wherein the binder phase comprises Ti, it was confirmed by CALPHAD methods that the said composition exhibits long term microstructural stability.

The high temperature stability of the cermets of the invention makes them suitable for applications where refractories are currently employed. A non-limiting list of suitable uses include liners for process vessels, transfer lines, cyclones, for example, fluid-solids separation cyclones as in the cyclone of Fluid Catalytic Cracking Unit used in refining industry, grid inserts, thermo wells, valve bodies, slide valve gates and guides, catalyst regenerators, and the like. Thus, metal surfaces exposed to erosive or corrosive environments, especially at about 300° C. to about 850° C. are protected by providing the surface with a layer of the cermet compositions of the invention. The cermets of the instant invention can be affixed to metal surfaces by mechanical means or by welding.

The cermets of the current invention are composites of a metal binder (RS) and hard ceramic particles (PQ). The ceramic particles in the cermet impart erosion resistance. In solid particle erosion, the impact of the erodent imposes complex and high stresses on the target. When these stresses exceed the cohesive strength of the target, cracks initiate in the target. Propagation of these cracks upon subsequent erodent impacts leads to material loss. A target material comprising coarser particles will resist crack initiation under erodent impacts as compared to a target comprising finer particles. Thus for a given erodent the erosion resistance of target can be enhanced by designing a coarser particle target. Producing defect free coarser ceramic particles and dense cermet compact comprising coarse ceramic particles are, however, long standing needs. Defects in ceramic particles (such as grain boundary and micropores) and cermet density affect the erosion performance and the fracture toughness of the cermet. In the instant invention coarser ceramic particles exceeding 20 microns, preferably exceeding 40 microns and even more preferably exceeding 60 microns but below about 3000 microns are preferred. A mixture of ceramic particles comprising finer ceramic particles in the size range of 0.1 to <20 microns diameter and coarser ceramic particles in the size range of 20 to 3000 microns diameter is preferred. One advantage of this mixture of ceramic particles is that it imparts better packing of the ceramic particles (PQ) in the composition (PQRS). This facilitates high, green body density which in turn leads to a dense cermet compact when processed according to the processing described above. The distribution of ceramic particles in the mixture can be bi-modal, tri-modal or multi-modal. The distribution can further be gaussian, lorenztian or asymptotic. Preferably the ceramic phase (PQ) is $TiB_2$.

EXAMPLES

Determination of Volume Percent:

The volume percent of each phase, component and the pore volume (or porosity) were determined from the 2-dimensional area fractions by the Scanning Electron Microscopy method. Scanning Electron Microscopy (SEM) was conducted on the sintered cermet samples to obtain a secondary electron image preferably at 1000× magnification. For the area scanned by SEM, X-ray dot image was obtained using Energy Dispersive X-ray Spectroscopy (EDXS). The SEM and EDXS analyses were conducted on five adjacent areas of the sample. The 2-dimensional area fractions of each phase was then determined using the image analysis software: EDX Imaging/Mapping Version 3.2 (EDAX Inc, Mahwah, N.J. 07430, USA) for each area. The arithmetic average of the area fraction was determined from the five measurements. The volume percent (vol %) is then determined by multiplying the average area fraction by 100. The vol % expressed in the examples have an accuracy of +/−50% for phase amounts measured to be less than 2 vol % and have an accuracy of +/−20% for phase amounts measured to be 2 vol % or greater.

Determination of Weight Percent:

The weight percent of elements in the cermet phases was determined by standard EDXS analyses.

The following non-limiting examples are included to further illustrate the invention.

Titanium diboride powder was obtained from various sources. Table 1 lists $TiB_2$ powder used for high temperature erosion/corrosion resistant boride cermets. Other boride powders such as $HfB_2$ and $TaB_2$ were obtained form Alfa Aesar. The particles are screened below 325 mesh (−44 μm) (standard Tyler sieving mesh size).

TABLE 1

| Company | Grade | Chemistry (wt %) | Size |
|---|---|---|---|
| Alfa Aesar | N/A | N/A | 14.0 μm, 99% −325 mesh |
| GE Advanced Ceramics | HCT30 | Ti: 67–69%, B: 29–32%, C: 0.5% max, O: 0.5% max, N: 0.2% max, Fe: 0.02% max | 14.0 μm, 99% −325 mesh |
| GE Advanced Ceramics | HCT40 | Ti: 67–69%, B: 29–32%, C: 0.75% max, O: 0.75% max, N: 0.2% max, Fe: 0.03% max | 14.0 μm, 99% −325 mesh |
| H. C. Starck | D | Ti: Balance, B: 29.0% min, C: 0.5% max, 0:1.1% max, N: 0.5% max, Fe: 0.1% max | 3–6 μm ($D_{50}$) 9–12 μm ($D_{90}$) |
| Japan New Metals | NF | Ti: Balance, B: 30.76%, C: 0.24%, O: 1.33%, N: 0.64%, Fe: 0.11% | 1.51 μm |
| Japan New Metals | N | Ti: Balance, B: 31.23%, C: 0.39%, O: 0.35%, N: 0.52%, Fe: 0.15% | 3.59 μm |
| H. C. Starck | S | Ti: Balance, B: 31.2%, C: 0.4%, O: 0.1%, N: 0.01%, Fe: 0.06% (Development product: Similar to Lot 50356) | $D_{10}$ = 7.68 μm, $D_{50}$ = 16.32 μm, $D_{90}$ = 26.03 μm |
| H. C. Starck | SLG | Ti: Balance, B: 30.9%, C: 0.3%, O: 0.2%, N: 0.2%, Fe: 0.04% (Development product: Similar to Lot 50412) | +53–180 μm |
| H. C. Starck | S2ELG | Ti: Balance, B: 31.2%, C: 0.9%, O: 0.04%, N: 0.02%, Fe: 0.09% (Development product: Similar to Lot 50216) | +106–800 μm |

Metal alloy powders that were prepared via Ar gas atomization method were obtained from Osprey Metals (Neath, UK). Metal alloy powders that were reduced in size, by conventional size reduction methods to a particle size, desirably less than 20 μm, preferably less than 5 μm, where more than 95% alloyed binder powder were screened below 16 μm. Some alloyed powders that were prepared via Ar gas atomization method were obtained from Praxair (Danbury, Conn.). These powders have average particle size about 15 μm where all alloyed binder powders were screened below −325 mesh (−44 μm). Table 2 lists alloyed binder powder used for high temperature erosion/corrosion resistant boride cermets.

TABLE 2

| Alloy Binder | Composition | Screened below |
|---|---|---|
| 304SS | BalFe: 18.5 Cr: 9.6 Ni: 1.4 Mn: 0.63 Si | 95.9%–16 μm |
| 347SS | BalFe: 18.1 Cr: 10.5 Ni: 0.97 Nb: 0.95 Mn: 0.75 Si | 95.0%–16 μm |
| FeCr | BalFe: 26.0 Cr | −150 +325 mesh |
| FeCrAlY | BalFe: 19.9 Cr: 5.3 Al: 0.64 Y | 95.1%–16 μm |
| Haynes ® 556 | BalFe: 20.7 Cr: 20.3 Ni: 18.5 Co: 2.7 Mo: 2.5 W: 0.99 Mn: 0.43 Si: 0.40 Ta | 96.2%–16 μm |
| Haynes ® 188 | BalCo: 22.4 Ni: 21.4 Cr: 14.1 W: 2.1 Fe: 1.0 Mn: 0.46 Si | 95.6%–16 μm |
| FeNiCrAlMn | BalFe: 21.7 Ni: 21.1 Cr: 5.8 Al: 3.0 Mn: 0.87 Si | 95.8%–16 μm |
| Inconel 718 | BalNi: 19 Cr: 18 Fe: 5.1 Nb/Ta: 3.1 Mo: 1.0 Ti | 100% −325 mesh (44 μm) |
| Inconel 625 | BalNi: 21.5 Cr: 9 Mo: 3.7 Nb/Ta | 100% −325 mesh (44 μm) |

TABLE 2-continued

| Alloy Binder | Composition | Screened below |
|---|---|---|
| Tribaloy 700 | BalNi: 32.5 Mo: 15.5 Cr: 3.5 Si | 100% −325 mesh (44 μm) |
| NiCr | 80 Ni: 20 Cr | −150 +325 mesh |
| NiCrSi | BalNi: 20.1 Cr: 2.0 Si: 0.4 Mn: 0.09 Fe | 95.0% −16 μm |
| NiCrAlTi | BalNi: 15.1 Cr: 3.7 Al: 1.3 Ti | 95.4% −16 μm |
| M321SS | BalFe: 17.2 Cr: 11.0 Ni: 2.5 Ti: 1.7 Mn: 0.84 Si: 0.02 C | 95.3% −16 μm |
| 304SS + 0.2 Ti | BalFe: 19.3 Cr: 9.7 Ni: 0.2 Ti: 1.7 Mn: 0.82 Si: 0.017 C | 95.1% −16 μm |

In Table 2, "Bal" stands for "as balance". HAYNES® 556™ alloy (Haynes International, Inc., Kokomo, Ind.) is UNS No. R30556 and HAYNES® 188 alloy is UNS No. R30188. INCONEL 625™ (Inco Ltd., Inco Alloys/Special Metals, Toronto, Ontario, Canada) is UNS N06625 and INCONEL 718™ UNS N07718. TRIBALOY 700™ (E. I. Du Pont De Nemours & Co., DE) can be obtained from Deloro Stellite Company Inc., Goshen, Ind.

Example 1

70 vol % of 14.0 μm average diameter of $TiB_2$ powder (99.5% purity, from Alfa Aesar, 99% screened below −325 mesh) and 30 vol % of 6.7 μm average diameter 304SS powder (Osprey metals, 95.9% screened below −16 μm) were dispersed with ethanol in HDPE milling jar. The powders in ethanol were mixed for 24 hours with yttria toughened zirconia balls (10 mm diameter, from Tosoh Ceramics) in a ball mill at 100 rpm. The ethanol was removed from the mixed powders by heating at 130° C. for 24 hours in a vacuum oven. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held for 30 min for residual solvent removal. The disc was then heated to 1500° C. at 15° C./min in argon and held at 1500° C. for 2 hours. The temperature was then reduced to below 100° C. at −15° C./min.

The resultant cermet comprised:

i) 69 vol % $TiB_2$ with average grain size of 7 μm ii) 4 vol % secondary boride $M_2B$ with average grain size of 2 μm, where M=54Cr:43Fe:3Ti in wt % iii) 27 vol % Cr-depleted alloy binder (73Fe:10Ni:14Cr:3Ti in wt %).

Example 2

75 vol % of 14.0 μm average diameter of $TiB_2$ powder (99.5% purity, from Alfa Aesar, 99% screened below −325 mesh) and 25 vol % of 6.7 μm average diameter 304SS powder (Osprey Metals, 95.9% screened below −16 μm) were used to process the cermet disc as described in Example 1. The cermet disc was then heated to 1700° C. at 15° C./min in argon and held at 1700° C. for 30 minutes. The temperature was then reduced to below 100° C. at −15° C./min.

The resultant cermet comprised:

i) 74 vol % $TiB_2$ with average grain size of 7 μm ii) 3 vol % secondary boride $M_2B$ with average grain size of 2 μm iii) 23 vol % Cr-depleted alloy binder.

Figure 2:
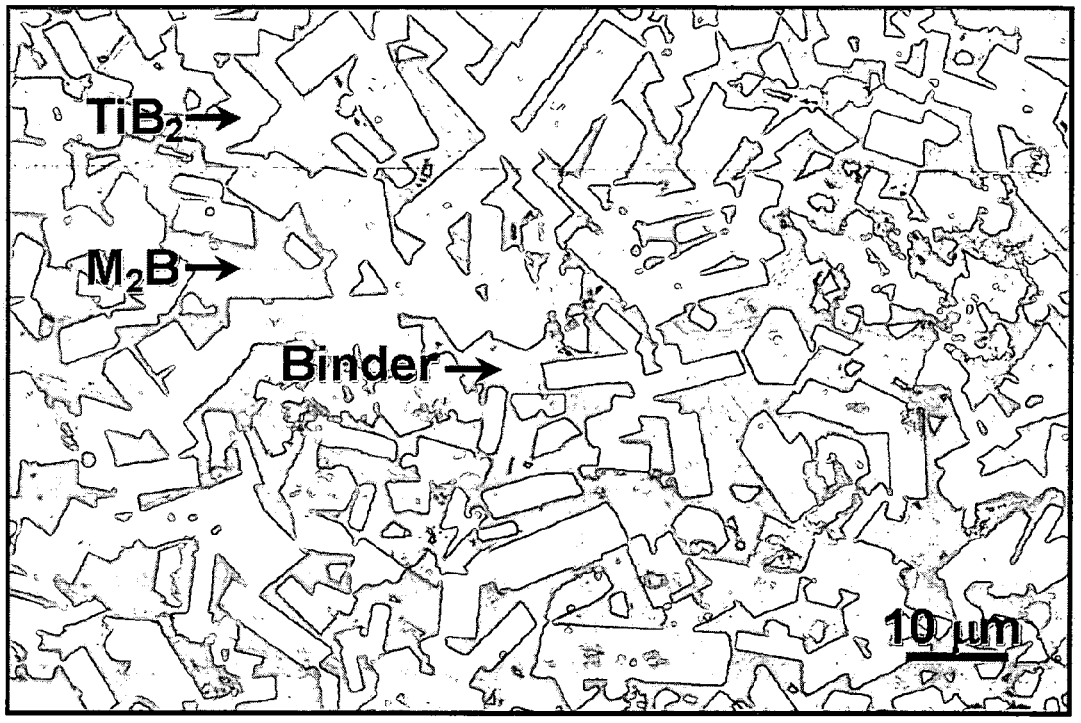
FIG. 2 is a scanning electron microscope (SEM) image of $TiB_2$ cermet made using 25 vol % 304 stainless steel (SS) binder.
Figure 3:
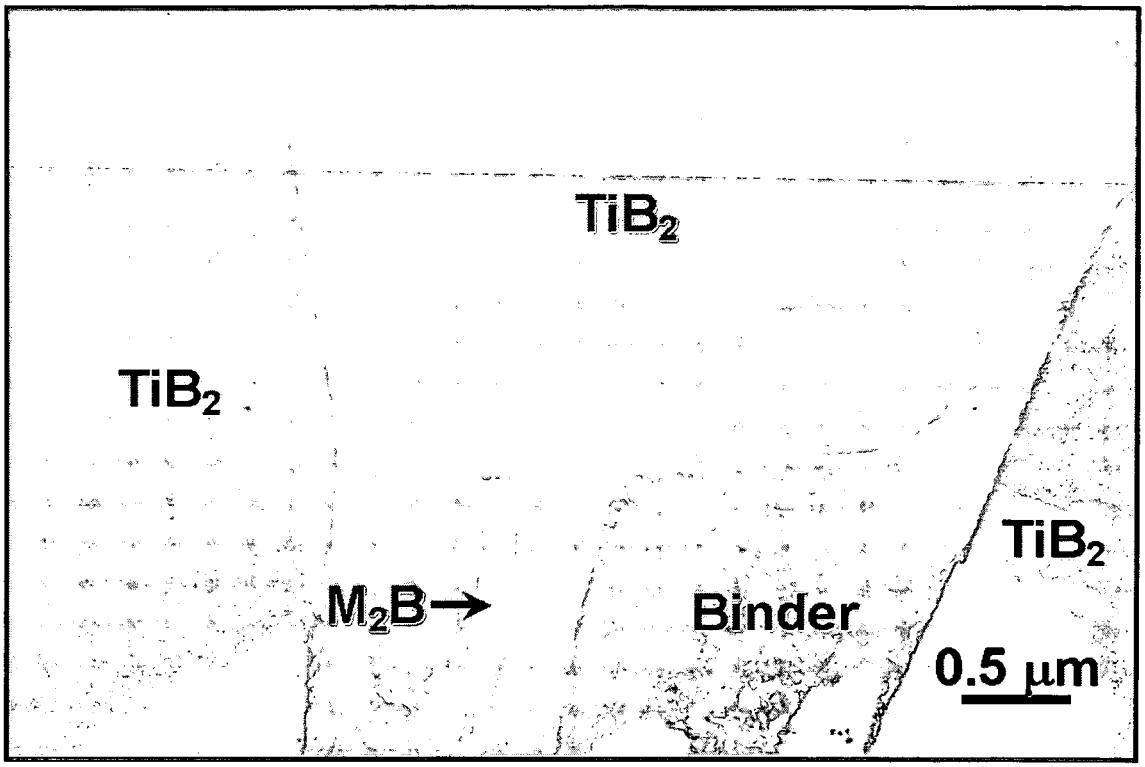
FIG. 3 is a transmission electron microscope (TEM) image of the same cermet shown in FIG. 2.

FIG. 2 is a SEM image of $TiB_2$ cermet processed according to this example, wherein the bar represents 10 μm. In this image $TiB_2$ phase appears dark and the binder phase appears light. The Cr-rich $M_2B$ type secondary boride phase is also shown in the binder phase. By M-rich, for example Cr-rich, is meant the metal M is of a higher proportion than the other constituent metals comprising M. FIG. 3 is a TEM image of the same cermet, wherein the scale bar represents 0.5 μm. In this image Cr-rich $M_2B$ type secondary boride phase appears dark in the binder phase. The metal element (M) of the secondary boride $M_2B$ phase comprises of 54Cr:43Fe:3Ti in wt %. The chemistry of binder phase is 71Fe:11Ni:15Cr:3Ti in wt %, wherein Cr is depleted due to the precipitation of Cr-rich $M_2B$ type secondary boride and Ti is enriched due to the dissolution of $TiB_2$ ceramic particles in the binder and subsequent partitioning into $M_2B$ secondary borides.

Example 3

70 vol % of 14.0 μm average diameter of $TiB_2$ powder (99.5% purity, from Alfa Aesar, 99% screened below −325 mesh) and 30 vol % of 6.7 μm average diameter 304SS powder (Osprey Metals, 95.9% screened below −16 μm) were used to process the cermet disc as described in Example 1. The cermet disc was then heated to 1500° C. at 15° C./min in argon and held for 2 hours. The temperature was then reduced to below 100° C. at −15° C./min. The pre-sintered disc was hot isostatically pressed to 1600° C. and 30 kpsi (206 MPa) at 12° C./min in argon and held at 1600° C. and 30 kpsi (206 MPa) for 1 hour. Subsequently it cooled down to 1200° C. at 5° C./min and held at 1200° C. for 4 hours. The temperature was then reduced to below 100° C. at −30° C./min.

The resultant cermet comprised:

i) 69 vol % $TiB_2$ with average grain size of 7 μm
ii) 4 vol % secondary boride $M_2B$ with average grain size of 2 μm, where M=55Cr:42Fe:3Ti in wt %
iii) 27 vol % Cr-depleted alloy binder (74Fe:12Ni:12Cr:2Ti in wt %).

Example 4

75 vol % of 14.0 μm average diameter of $TiB_2$ powder (99.5% purity, from Alfa Aesar, 99% screened below −325 mesh) and 25 vol % of 6.7 μm average diameter Haynes® 556 alloy powder (Osprey metals, 96.2% screened below −16 μm) were used to process the cermet disc as described in Example 1. The cermet disc was then heated to 1700° C. at 15° C./min in argon and held at 1700° C. for 30 minutes. The temperature was then reduced to below 100° C. at −15° C./min.

The resultant cermet comprised:

i) 74 vol % $TiB_2$ with average grain size of 7 μm
ii) 2 vol % secondary boride $M_2B$ with average grain size of 2 μm, where M=68Cr:23Fe:6Co:2Ti:1Ni in wt %
iii) 1 vol % secondary boride $M_2B$ with average grain size of 2 μm, where M=CrMoTiFeCoNi
iv) 23 vol % Cr-depleted alloy binder (40Fe:22Ni:19Co:16Cr:3Ti in wt %).

Example 5

80 vol % of 14.0 μm average diameter of $TiB_2$ powder (99.5% purity, from Alfa Aesar, 99% screened below −325 mesh) and 20 vol % of FeCr alloy powder (99.5% purity, from Alfa Aesar, screened between −150 mesh and +325 mesh) were used to process the cermet disc as described in Example 1. The cermet disc was then heated to 1700° C. at 15° C./min in argon and held at 1700° C. for 30 minutes. The temperature was then reduced to below 100° C. at −15° C./min.

The resultant cermet comprised:

i) 79 vol % $TiB_2$ with average grain size of 7 μm
ii) 7 vol % secondary boride $M_2B$ with average grain size of 2 μm, where M=56Cr:41Fe:3Ti in wt %
iii) 14 vol % Cr-depleted alloy binder (82Fe:16Cr:2Ti in wt %).

Example 6

80 vol % of 14.0 μm average diameter of $TiB_2$ powder (99.5% purity, from Alfa Aesar, 99% screened below −325 mesh) and 20 vol % of FeCrAlY alloy powder (Osprey Metals, 95.1% screened below −16 μm) were used to process the cermet disc as described in Example 1. The cermet disc was then heated to 1500° C. at 15° C./min in argon and held at 1500° C. for 2 hours. The temperature was then reduced to below 100° C. at −15° C./min.

The resultant cermet comprised:

i) 79 vol % $TiB_2$ with average grain size of 7 μm
ii) 4 vol % secondary boride $M_2B$ with average grain size of 2 μm, where M=53Cr:45Fe:2Ti in wt %
iii) 1 vol % Al—Y oxide particles
iv) 16 vol % Cr-depleted alloy binder (78Fe:17Cr:3Al:2Ti in wt %).

Figure 4:
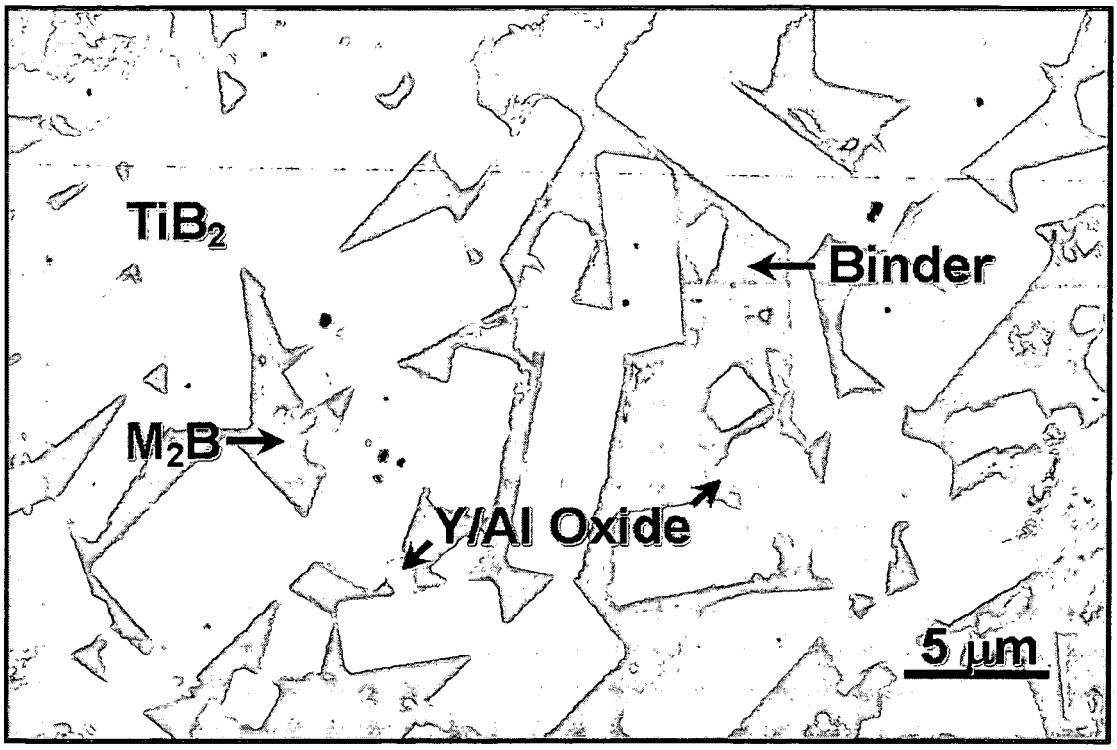
FIG. 4 is a SEM image of a selected area of $TiB_2$ cermet made using 20 vol % FeCrAlY alloy binder.
Figure 5:
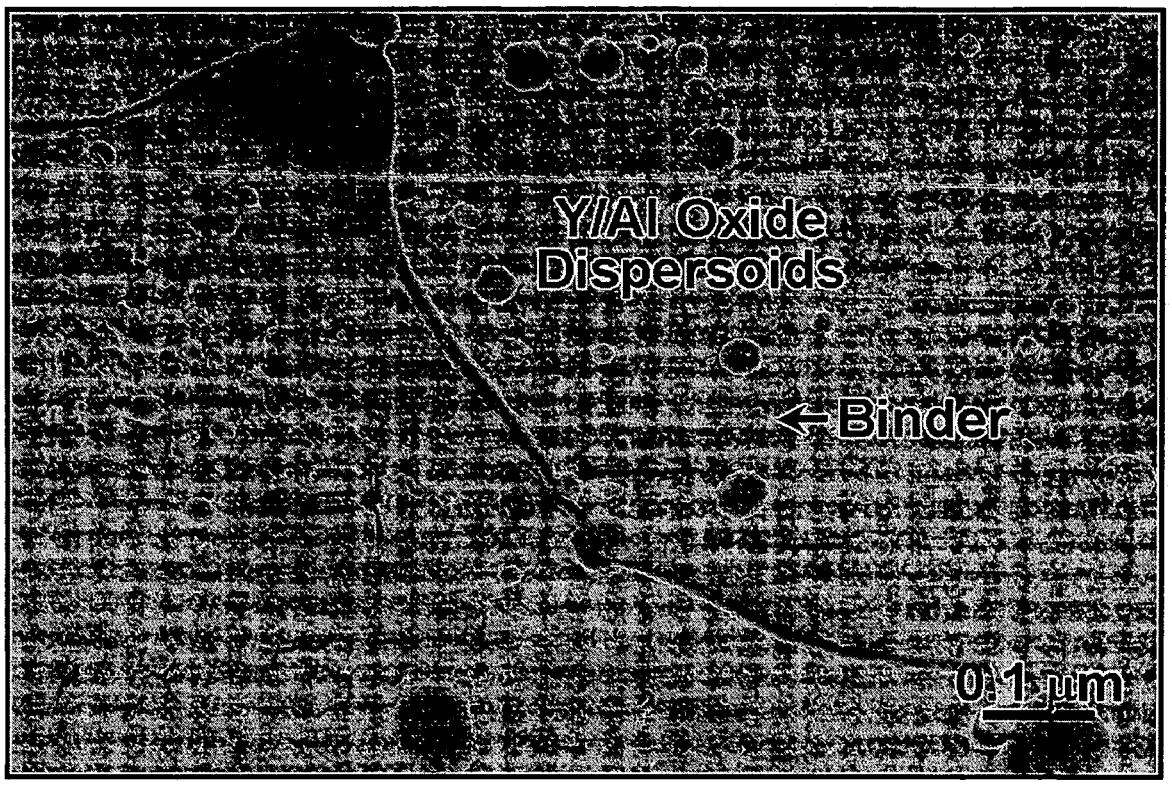
FIG. 5 is a TEM image of the selected binder area as shown in FIG. 4.

FIG. 4 is a SEM image of $TiB_2$ cermet processed according to this example, wherein the scale bar represents 5 μm. In this image the $TiB_2$ phase appears dark and the binder phase appears light. The Cr-rich $M_2B$ type boride phase and the Y/Al oxide phase are also shown in the binder phase. FIG. 5 is a TEM image of the selected binder area as in FIG. 4, but wherein the scale bar represents 0.1 μm. In this image fine Y/Al oxide dispersoids with size ranging 5–80 nm appears dark and the binder phase appears light. Since Al and Y are strong oxide forming elements, these element can pick up residual oxygen from powder metallurgy processing to form oxide dispersoids.

Example 7

Each of the cermets of Examples 1 to 6 was subjected to a hot erosion and attrition test (HEAT). The procedure employed was as follows:

1) A specimen cermet disk of about 35 mm diameter and about 5 mm thick was weighed.

2) The center of one side of the disk was then subjected to 1200 g/min of SiC particles (220 grit, #1 Grade Black Silicon Carbide, UK abrasives, Northbrook, Ill.) entrained in heated air exiting from a tube with a 0.5 inch diameter ending at 1 inch from the target at an angle of 45°. The velocity of the SiC was 45.7 m/sec.

3) Step (2) was conducted for 7 hrs at 732° C.

4) After 7 hours the specimen was allowed to cool to ambient temperature and weighed to determine the weight loss.

5) The erosion of a specimen of a commercially available castable alumina refractory was determined and used as a Reference Standard. The Reference Standard erosion was given a value of 1 and the results for the cermet specimens are compared in Table 3 to the Reference Standard. In Table 3 any value greater than 1 represents an improvement over the Reference Standard.

TABLE 3

| Cermet {Example} | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| $TiB_2$-30 304SS {1} | 15.7063 | 15.2738 | 0.4325 | 5.52 | 5.22E + 5 | 1.5010E − 7 | 7.0 |
| $TiB_2$-25 304SS {2} | 19.8189 | 19.3739 | 0.4450 | 5.37 | 5.04E + 5 | 1.6442E − 7 | 6.4 |
| $TiB_2$-30 304SS {3} | 18.8522 | 18.5629 | 0.2893 | 5.52 | 5.04E + 5 | 1.0399E − 7 | 10.1 |
| $TiB_2$-25 H556 {4} | 19.4296 | 18.4904 | 0.9392 | 5.28 | 5.04E + 5 | 3.5293E − 7 | 3.0 |
| $TiB_2$-20 FeCr {5} | 20.4712 | 20.1596 | 0.3116 | 5.11 | 5.04E + 5 | 1.2099E − 7 | 8.7 |
| $TiB_2$-20 FeCrAlY {6} | 14.9274 | 14.8027 | 0.1247 | 4.90 | 5.04E + 5 | 5.0494E − 8 | 17.4 |

Example 8

Each of the cermets of Examples 1 to 6 was subjected to an oxidation test. The procedure employed was as follows:

1) A specimen cermet of about 10 mm square and about 1 mm thick was polished to 600 grit diamond finish and cleaned in acetone.

2) The specimen was then exposed to 100 cc/min air at 800° C. in thermogravimetric analyzer (TGA).

3) Step (2) was conducted for 65 hrs at 800° C.

4) After 65 hours the specimen was allowed to cool to ambient temperature.

5) Thickness of oxide scale was determined by cross sectional microscopic examination of the corrosion surface in a SEM.

6) In Table 4 any value less than 150 μm represents acceptable corrosion resistance.

TABLE 4

| Cermet {Example} | Thickness of Oxide Scale (μm) |
|---|---|
| $TiB_2$-30 304SS {1} | 17 |
| $TiB_2$-25 30455 {2} | 20 |
| $TiB_2$-30 30455 {3} | 17 |
| $TiB_2$-25 11556 {4} | 14 |
| $TiB_2$-20 FeCr {5} | 15 |
| $TiB_2$-20 FeCrAlY {6} | 15 |

Figure 6:
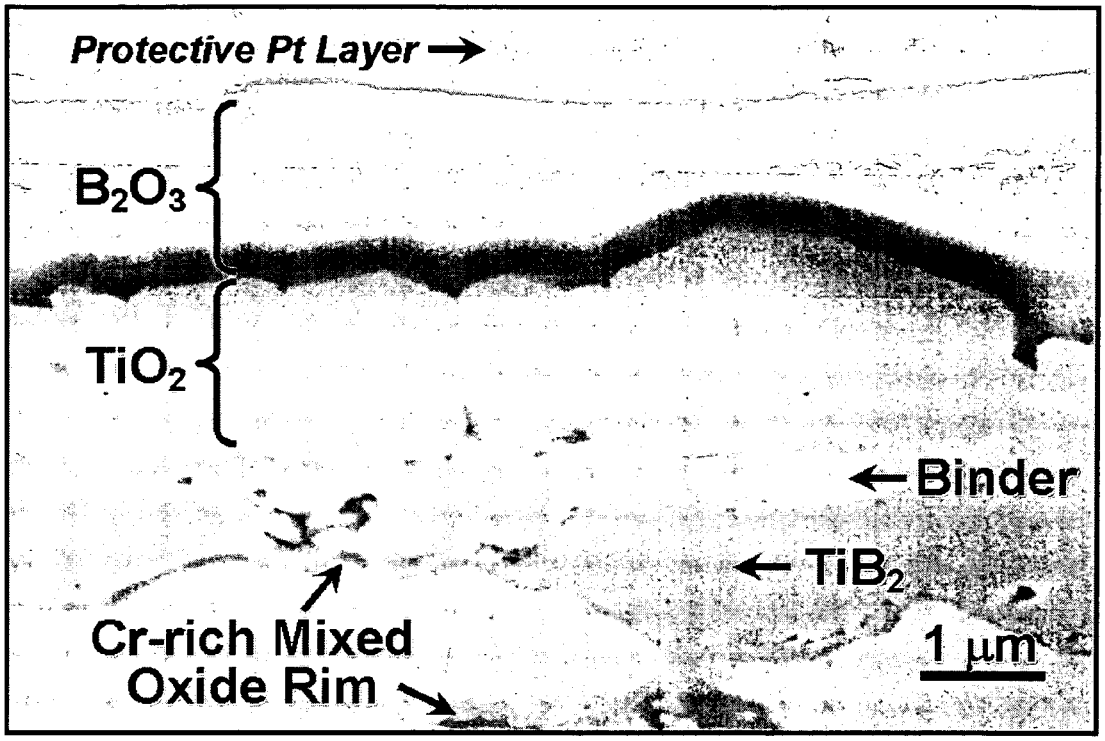
FIG. 6 is a cross sectional secondary electron image obtained by a focussed ion beam (FIB) microscopy of a $TiB_2$ cermet made using 25 vol % Haynes® 556 alloy binder illustrating surface oxide scales after oxidation at 800° C. for 65 hours in air.

FIG. 6 is a cross sectional secondary electron image of a $TiB_2$ cermet made using 25 vol % Haynes® 556 alloyed binder (as described in Example 4), wherein the scale bar represents 1 μm. This image was obtained by a focussed ion beam (FIB) microscopy. After oxidation at 800° C. for 65 hours in air, about 3 μm thick external oxide layer and about 11 μm thick internal oxide zone were developed. The external oxide layer has two layers: an outer layer primarily of amorphous $B_2O_3$ and an inner layer primarily of crystalline $TiO_2$. The internal oxide zone has Cr-rich mixed oxide rims formed around $TiB_2$ grains. Only part of internal oxide zone is shown in the figure. The Cr-rich mixed oxide rim is further composed of Cr, Ti and Fe, which provides required corrosion resistance.

Example 9

70 vol % of 14.0 μm average diameter of $HfB_2$ powder (99.5% purity, from Alfa Aesar, 99% screened below −325 mesh) and 30 vol % of 6.7 μm average diameter Haynes® 556 alloy powder (Osprey Metals, 96.2% screened below −16 μm) were used to process the cermet disc as described in Example 1. The cermet disc was then heated to 1700° C. at 15° C./min in hydrogen and held at 1700° C. for 2 hours. The temperature was then reduced to below 100° C. at −15° C./min.

The resultant cermet comprised:

i) 69 vol % $HfB_2$ with average grain size of 7 μm ii) 2 vol % secondary boride $M_2B$ with average grain size of 2 μm, where M=CrFeCoHfNi iii) 1 vol % secondary boride $M_2B$ with average grain size of 2 μm, where M=CrMoHfFeCoNi iv) 28 vol % Cr-depleted alloy binder.

Example 10

70 vol % of 1.5 μm average diameter of $TiB_2$ powder (NF grade from Japan New Metals Company) and 30 vol % of 6.7 μm average diameter 304SS powder (Osprey Metals, 95.9% screened below −16 μm) were used to process the cermet disc as described in Example 1. The cermet disc was then heated to 1700° C. at 15° C./min in hydrogen and held at 1700° C. for 2 hours. The temperature was then reduced to below 100° C. at −15° C./min.

The resultant cermet comprised:

i) 67 vol % $TiB_2$ with average grain size of 1.5 μm ii) 9 vol % secondary boride $M_2B$ with average grain size of 2 μm, where M=46Cr:51Fe:3Ti in wt % iii) 24 vol % Cr-depleted alloy binder (75Fe:14Ni:7Cr:4Ti in wt %).

Example 11

70 vol % of 3.6 μm average diameter of $TiB_2$ powder (D grade from H.C. Stark Company) and 30 vol % of 6.7 μm average diameter 304SS powder (Osprey Metals, 95.9% screened below −16 μm) were used to process the cermet disc as described in Example 1. The cermet disc was then heated to 1700° C. at 15° C./min in hydrogen and held at 1700° C. for 2 hours. The temperature was then reduced to below 100° C. at −15° C./min.

The resultant cermet comprised:

i) 69 vol % $TiB_2$ with average grain size of 3.5 μm ii) 6 vol % secondary boride $M_2B$ with average grain size of 2 μm, where M=50Cr:47Fe:3Ti in wt % iii) 25 vol % Cr-depleted alloy binder (75Fe:12Ni:10Cr:3Ti in wt %).

Example 12

76 vol % of $TiB_2$ powder mix (H. C. Starck's: 32 grams S grade and 32 grams S2ELG grade) and 24 vol % of 6.7 μm average diameter M321SS powder (Osprey metals, 95.3% screened below −16 μm, 36 grams powder) were used to process the cermet disc as described in example 1. The $TiB_2$ powder exhibits a bi-modal distribution of particles in the size range 3 to 60 μm and 61 to 800 μm. Enhanced long term microstructural stability is provided by the M321SS binder. The cermet disc was then heated to 1700° C. at 5° C./min in argon and held at 1700° C. for 3 hours. The temperature was then reduced to below 100° C. at −15° C./min.

The resultant cermet comprised:

i) 79 vol % $TiB_2$ with sizes ranging from 5 to 700 μm ii) 5 vol % secondary boride $M_2B$ with average grain size of 10 μm, where M=54Cr:43Fe:3Ti in wt % iii) 16 vol % Cr-depleted alloy binder (73Fe:10Ni:14Cr:3Ti in wt %).

Example 13

66 vol % of $TiB_2$ powder mix (H. C. Starck's: 26 grams S grade and 26 grams S2ELG grade) and 34 vol % of 6.7 μm average diameter 304SS+0.2Ti powder (Osprey metals, 95.1% screened below −16 μm, 48 grams powder) were used to process the cermet disc as described in Example 1. The $TiB_2$ powder exhibits a bi-modal distribution of particles in the size range 3 to 60 μm and 61 to 800 μm. Enhanced long term microstructural stability is provided by the 304SS+0.2Ti binder. The cermet disc was then heated to 1600° C. at 5° C./min in argon and held at 1600° C. for 3 hours. The temperature was then reduced to below 100° C. at −15° C./min.

The resultant cermet comprised:

i) 63 vol % $TiB_2$ with sizes ranging from 5 to 700 μm ii) 7 vol % secondary boride $M_2B$ with average grain size of 10 μm, where M=47Cr:50Fe:3Ti in wt % iii) 30 vol % Cr-depleted alloy binder (74Fe:11Ni:12Cr:3Ti in wt %).

Figure 7:
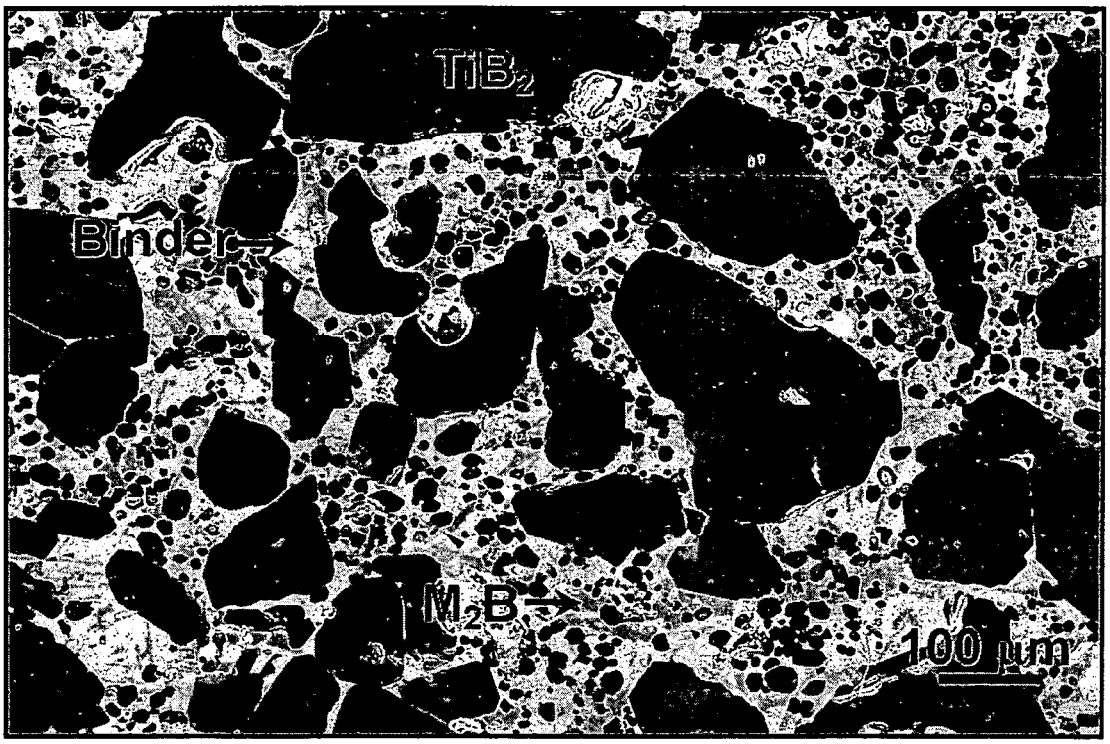
FIG. 7 is a scanning electron microscope (SEM) image of $TiB_2$ cermet made using 34 vol % 304SS+0.2Ti binder

FIG. 7 is a SEM image of $TiB_2$ cermet processed according to this example, wherein the scale bar represents 100 μm. In this image the $TiB_2$ phase appears dark and the binder phase appears light. The Cr-rich $M_2B$ type secondary boride phase is also shown in the binder phase.

Example 14

71 vol % of bi-modal $TiB_2$ powder mix (H. C. Starck's: 29 grams S grade and 29 grams S2ELG grade) and 29 vol % of 6.7 μm average diameter 304SS+0.2Ti powder (Osprey metals, 95.1% screened below −16 μm, 42 grams powder) were used to process the cermet disc as described in Example 1. The $TiB_2$ powder exhibits a bi-modal distribution of particles in the size range 3 to 60 μm and 61 to 800 μm. Enhanced long term microstructural stability is provided by the 304SS+0.2Ti binder. The cermet disc was then heated to 1480° C. at 5° C./min in argon and held at 1480° C. for 3 hours. The temperature was then reduced to below 100° C. at −15° C./min.

The resultant cermet comprised:

i) 67 vol % $TiB_2$ with sizes ranging from 5 to 700 μm ii) 6 vol % secondary boride $M_2B$ with average grain size of 10 μm, where M=49Cr:48Fe:3Ti in wt % iii) 27 vol % Cr-depleted alloy binder (73Fe:11Ni:13Cr:3Ti in wt %).

Example 15

Each of the cermets of Examples 12 to 14 was subjected to a hot erosion and attrition test (HEAT) as described in Example 7. The Reference Standard erosion was given a value of 1 and the results for the cermet specimens are compared in Table 5 to the Reference Standard. In Table 5 any value greater than 1 represents an improvement over the Reference Standard.

TABLE 5

| Cermet {Example} | Starting Weight (g) | Finish Weight (g) | Weight Loss (g) | Bulk Density (g/cc) | Erodant (g) | Erosion (cc/g) | Improvement [(Normalized erosion)$^{-1}$] |
|---|---|---|---|---|---|---|---|
| Bi-modal $TiB_2$-24 vol % M321SS {12} | 27.5714 | 27.3178 | 0.2536 | 5.32 | 5.04E + 5 | 9.4653E − 08 | 10.73 |
| Bi-modal $TiB_2$-34 vol % 304SS + 0.25 Ti {13} | 26.9420 | 26.6196 | 0.3224 | 5.49 | 5.04E + 5 | 1.1310E − 07 | 9.19 |
| Bi-modal $TiB_2$-29 vol % 304SS + 0.25 Ti {14} | 26.3779 | 26.0881 | 0.2898 | 5.66 | 5.04E + 5 | 1.0166E − 07 | 10.23 |

What is claimed is:

1. A cermet composition represented by the formula (PQ)(RS) comprising: a ceramic phase (PQ) and binder phase (RS) wherein, P is at least one transition metal element selected from the group consisting of Group IV, Group V, Group VI elements, Q is boride, R comprises at least about 66.7 wt % Fe based on the weight of the binder phase (RS) and a metal selected from the group consisting of Ni, Co, Mn and mixtures thereof, S comprises Ti in the range of 0.1 to 3.0 wt % based on the weight of the binder phase (RS), and at least one element selected from the group consisting of Cr, Al, Si and Y, wherein the ceramic phase (PQ) ranges from about 55 to 95 vol % based on the volume of the cermet.

2. The cermet composition of claim 1 wherein the molar ratio of P:Q in the ceramic phase (PQ) can vary in the range of 3:1 to 1:6.

3. The cermet composition of claim 1 wherein S further comprises at least one element selected from the group consisting of Zr, Hf; V, Nb, Ta, Mo and W.

4. The cermet composition of claim 1 further comprising a secondary boride (P'Q) wherein P' is selected from the group consisting of transition metal element of Group IV, Group V, or Group VI elements, Fe, Ni, Co, Mn, Cr, Al, Y, Si and mixtures thereof.

5. The cermet composition of claim 1 further comprising an oxide of a metal selected from the group consisting of Fe, Ni, Co, Mn, Al, Cr, Y, Si, Ti, Zr, Hf, V, Nb, Ta, Mo, W and mixtures thereof.

6. The cermet composition of claim 1 wherein said ceramic phase (PQ) is dispersed in the binder phase (RS) as particles in the size range of about 0.1 microns to 3000 microns diameter with at least 50% of the particles having a particle—particle spacing of at least about 1 nm.

7. The cermet composition of claim 6 wherein said particles comprise finer particles in the size range 0.1 to 20 microns diameter and coarser particles in the size range of 20 to 3000 microns diameter.

8. The cermet composition of claim 1 wherein said ceramic phase (PQ) is dispersed in the binder phase (RS) as platelets wherein the aspect ratio of length to thickness of the platelets is in the range of about 5:1 to 20:1.

9. The cermet composition of claim 1 wherein the binder phase (RS) is in the range of 5 to 45 vol % based on the volume or the cermet and the mass ratio of R to S ranges from 50/50 to 90/10.

10. The cermet composition of claim 9 wherein the combined weights of said Cr and Al is at least 12 wt % based on the weight of the binder phase (RS).

11. The cermet compositions of claim 1 having a long term microstructural stability lasting at least 25 years when exposed at temperatures up to 850° C.

12. The cermet composition of claim 1 having a fracture toughness greater than about 3 MPa $m^{1/2}$.

13. The cermet composition or claim 1 having an erosion rate less than about $0.5\times10^{-6}$ cc/gram of SiC erodant.

14. The cermet composition of claim 1 having corrosion rate less than about $1\times10^{-10}$ $g^2/cm^4\cdot s$ or an average oxide scale of less than 150 μm thickness when subject to 100 cc/min air at 800° C. for at least 65 hours.

15. The cermet composition of claim 1 having an erosion rate less than about $0.5\times10^{-6}$ cc/gram of SiC erodant and a corrosion rate less than about $1\times10^{-10}$ $g^2/cm^4\cdot s$ or an average oxide scale of less than 150 μm thickness when subject to 100 cc/min air at 800° C. for at least 65 hours.

16. The cermet composition of claim 1 having embrittling phases less than 5 vol % based on the volume of the cermet.

17. The cermet composition of claim 3 further comprising an oxide of a metal selected from the group consisting of Fe, Ni, Co, Mn, Al, Cr, Y, Si, Ti, Zr, Hf, V, Nb, Ta, Mo, W and mixtures thereof.

18. A bulk cermet material represented by the formula (PQ)(RS) comprising: a ceramic phase (PQ) and binder phase (RS) wherein, P is at least one transition metal element selected from the group consisting of Group IV, Group V, Group VI elements, Q is boride, R comprises at least about 66.7 wt % Fe based on the weight of the binder phase (RS) and a metal selected from the group consisting of Ni, Co, Mn and mixtures thereof;

S comprises Ti in the range of 0.1 to 3.0 wt % based on the weight of the binder phase (RS), and at least one element selected from the group consisting of Cr, Al, Si and Y, wherein the ceramic phase (PQ) ranges from about 55 to 95 vol % based on the volume of the cermet, and wherein the overall thickness of the bulk cermet material is greater than 5 millimeters.

19. The bulk cermet material of claim 18 wherein the molar ratio of P:Q in the ceramic phase (PQ) can vary in the range of 3:1 to 1:6.

20. The bulk cermet material of claim 18 wherein S further comprises at least one element selected from the group consisting of Zr, Hf, V, Nb, Ta, Mo and W.

21. The bulk cermet material of claim 18 further comprising a secondary boride (P'Q) wherein P' is selected from the group consisting of Group IV, Group V, or Group VI elements, Fe, Ni, Co, Mn, Al, Y, Si, and mixtures thereof.

22. The bulk cermet material of claim 18 further comprising an oxide of a metal selected from the group consisting of Fe, Ni, Co, Mn, Al, Cr, Y, Si, Ti, Zr, Hf, V, Nb, Ta, Mo, W and mixtures thereof.

23. The bulk cermet material of claim 18 wherein said ceramic phase (PQ) is dispersed in the binder phase (RS) as particles in the size range of about 0.1 microns to 3000 microns diameter with at least 50% of the particles having a particle—particle spacing of at least about 1 nm.

24. The bulk cermet material of claim 23 wherein said particles comprise finer particles in the size range 0.1 to 20 microns diameter and coarser particles in the size range of 20 to 3000 microns diameter.

25. The bulk cermet material of claim 18 wherein said ceramic phase (PQ) is dispersed in the binder phase (RS) as platelets wherein the aspect ratio of length to thickness of the platelets is in the range of about 5:1 to 20:1.

26. The bulk cermet material of claim 18 wherein the binder phase (RS) is in the range of 5 to 45 vol % based on the volume of the cermet and the mass ratio of R to S ranges from 50/50 to 90/10.

27. The bulk cermet material of claim 26 wherein the combined weights of said Cr and Al is at least 12 wt % based on the weight of the binder phase (RS).

28. The bulk cermet material of claim 18 having a long term microstructural stability lasting at least 25 years when exposed at temperatures up to 850° C.

29. The bulk cermet material of claim 18 having a fracture toughness greater than about 3 MPa $m^{1/2}$.

30. The bulk cermet material of claim 18 having an erosion rate less than about $0.5\times10^{-6}$ cc/gram of SiC erodant.

31. The bulk cermet material of claim 18 having corrosion rate less than about $1\times10^{-10}$ $g^2/cm^4\cdot s$ or an average oxide scale of less than 150 μm thickness when subject to 100 cc/min air at 800° C. for at least 65 hours.

32. The bulk cermet material of claim 18 having an erosion rate less than about $0.5\times10^{-6}$ cc/gram of SiC erodant and a corrosion rate less than about $1\times10^{-10}$ $g^2/cm^4\cdot s$ or an average oxide scale of less than 150 μm thickness when subject to 100 cc/min air at 800° C. for at least 65 hours.

33. The bulk cermet material of claim 18 having embrittling phases less than 5 vol % based on the volume of the cermet.

34. The bulk cermet material of claim 20 further comprising an oxide of a metal selected from the group consisting of Fe, Ni, Co, Mn, Al, Cr, Y, Si, Ti, Zr, HF, V, Nb, Ta, Mo, W and mixtures thereof.

* * * * *